United States Patent [19]

Cosar et al.

[11] 4,419,940

[45] Dec. 13, 1983

[54] BOILER INSTALLATION

[75] Inventors: Paul Cosar, Paris; Raoul Teraube, Beauchamps, both of France

[73] Assignee: Fives-Cail Babcock, Paris, France

[21] Appl. No.: 442,143

[22] Filed: Nov. 16, 1982

[30] Foreign Application Priority Data

Nov. 25, 1981 [FR] France ..... 81 22023

[51] Int. Cl.[3] ..... F23G 5/00

[52] U.S. Cl. ..... 110/229; 110/234; 110/245; 110/248; 110/231; 122/2; 122/22; 122/15; 122/4 D

[58] Field of Search ..... 110/229–231, 110/234, 244, 245, 248, 251; 122/2, 15, 22, 211, 4 D

[56] References Cited

U.S. PATENT DOCUMENTS

| | | | |
|---|---|---|---|
| 1,592,281 | 7/1926 | Maignen | 110/231 |
| 2,642,019 | 6/1953 | Cushing et al. | 110/234 |
| 3,311,090 | 3/1967 | Lee | 122/2 |
| 4,274,341 | 6/1981 | Ozaltay | 110/229 |
| 4,344,371 | 8/1982 | Zoschak | 110/229 |

FOREIGN PATENT DOCUMENTS

| | | | |
|---|---|---|---|
| 960305 | 3/1957 | Fed. Rep. of Germany | 110/229 |
| 27702 | 8/1924 | France | 110/231 |
| 709832 | 8/1931 | France | 110/231 |

*Primary Examiner*—Henry C. Yuen

*Attorney, Agent, or Firm*—Kurt Kelman

[57] ABSTRACT

Sulfur is readily and efficiently removed from solid fuel in a boiler installation which comprises a hearth for burning and thereby gasifying the solid fuel, the hearth including a grid supporting a fluidized bed of the solid fuel spread thereover, and a tubular boiler body superimposed on, and integral with, the hearth, the boiler body including a lower portion receiving the gasified fuel from the hearth, an upper portion, a common transverse wall dividing the tubular boiler body into the lower and upper portions, and a burner extending into the upper boiler body portion near the dividing transverse wall and receiving a supply of secondary combustion air. A conduit connects the lower boiler body portion to the burner for feeding the gasified fuel therefrom to the burner, and dust removing and desulfurization cyclones in the conduit remove dust and sulfur from the gasified fuel.

11 Claims, 5 Drawing Figures

BOILER INSTALLATION

The present invention relates to improvements in a boiler installation operated with solid fuel, such as coal or any other solid fuel, for example shale, having a high sulfur content. More particularly, this invention relates to a boiler installation comprising a hearth for burning and thereby gasifying a solid fuel, the hearth including a grid supporting a fluidized bed of the solid fuel spread thereover, and means for blowing primary combustion air through the grid from below, and a tubular boiler body superimposed on the hearth and including an inlet receiving a supply of secondary combustion air.

The elimination of sulfur from a solid fuel poses delicate problems. It cannot be effected near the hearth because of the high temperatures of the order of 1200° C. prevailing there. This has lead to the elimination of sulfur from the cold exhaust gases of the boiler. This, however, has a number of disadvantages. In the first place, the exhaust gas volume is considerable and, secondly, the low temperatures at this point are also not favorable to desulfurization, for which reason it has been necessary to reheat the exhaust gases.

It is the primary object of the invention to avoid these operating inconveniences by applying the technique of fluidized beds to the gasification of solid fuels, combining this with an otherwise conventional boiler with a two-stage tubular boiler body, and using the desulfurized gasified fuel in a burner mounted in the upper stage of the boiler body which forms a combustion chamber.

In a boiler installation of the above-defined structure, the above and other objects are accomplished according to the present invention with a tubular boiler body superimposed on, and integral with, the hearth, the boiler body including a lower portion receiving the gasified fuel from the hearth, an upper portion, a common transverse wall dividing the tubular boiler body into the lower and upper portions, and a burner extending into the upper boiler body portion near the dividing transverse wall and receiving a supply of secondary combustion air. Conduit means connect the lower boiler body portion to the burner for feeding the gasified fuel therefrom to the burner, and dust removing and desulfurization means in the conduit means remove dust and sulfur from the gasified fuel.

The above and other objects, advantages and features of this invention will become more apparent from the following detailed description of certain now preferred embodiments thereof, taken in conjunction with the accompanying, generally schematic drawing wherein FIG. 1 diagrammatically shows a side elevation, partly in section, of a boiler installation according to the invention;

Figure 1:
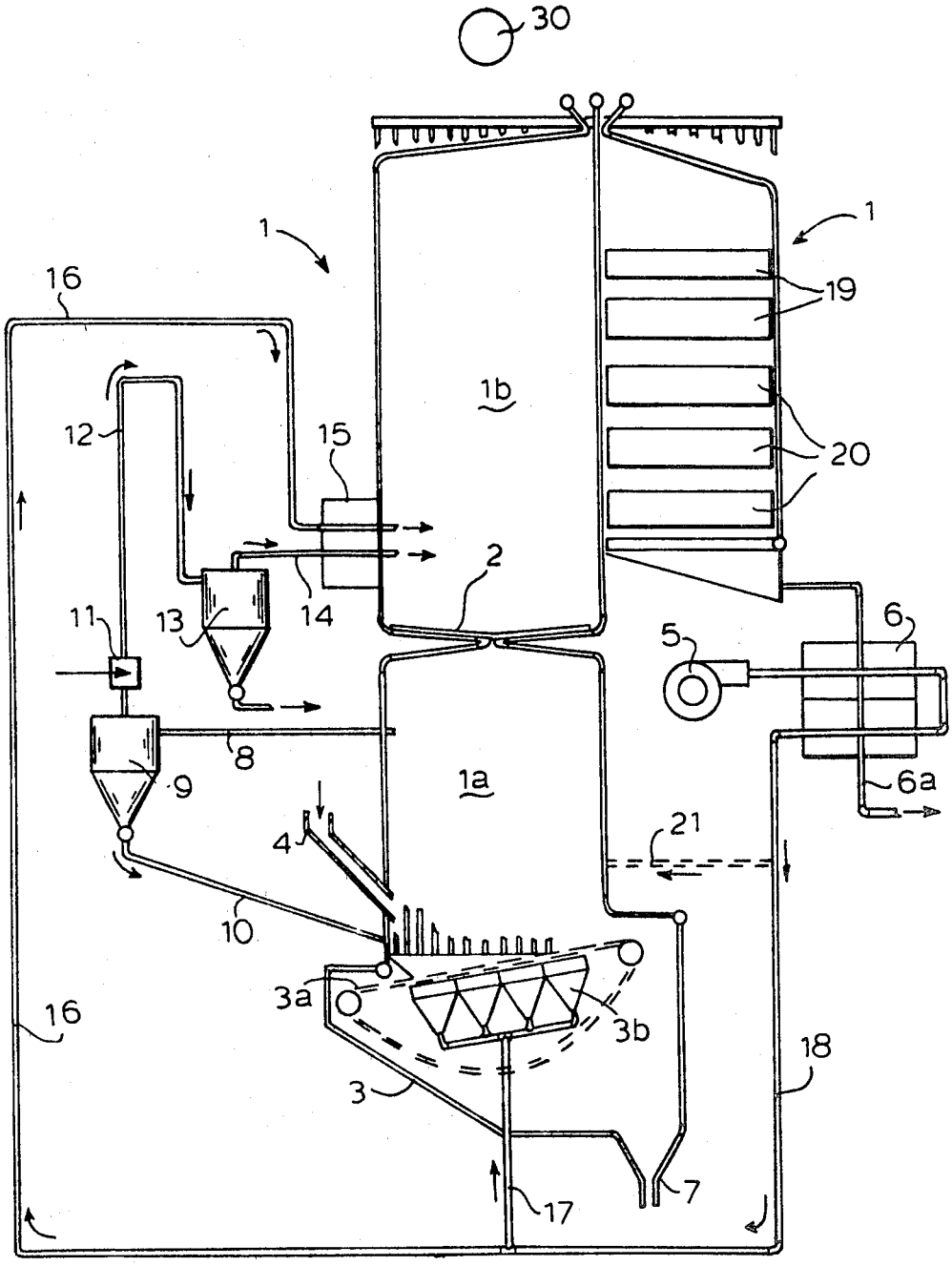

Referring now to the drawing, wherein like reference numerals designate like parts operating in a like manner in all figures, FIG. 1 illustrates a boiler installation comprising hearth 3 for burning and thereby gasifying a solid fuel and tubular boiler body 1 superimposed on, and integral with, hearth 3. The hearth includes grid 3*a* supporting a fluidized bed of the solid fuel spread thereover and means constituted by wind box 3*b* for blowing primary combustion air through the grid from below. The illustrated grid is downwardly inclined and mechanically movable to assure distribution of the primary combustion air and removal of ashes from the fluidized bed through outlet 7 in the hearth. As shown, the grid is constituted by an endless band trained over two guide rollers.

Tubular boiler body 1 formed of vertical tubes includes lower portion 1*a* receiving the gasified fuel from hearth 3, upper portion 1*b*, common transverse wall 2 dividing the tubular boiler body into the lower and upper portions, and burner 15 mounted in the wall of the upper boiler body portion, extending thereinto near the dividing transverse wall and receiving a supply of secondary combustion air through air supply conduit 16. The transverse dividing wall is advantageously constituted by radially inwardly extending folds of vertical tubes forming the boiler body. Chute 4 delivers the solid fuel, such as coal, into lower boiler body portion 1*a* above the grid to spread the fuel thereover. As shown in FIG. 1, the circuit for circulating the primary and secondary air to hearth 3 and burner 15, respectively, comprises fan 5 having an output for feeding the air thereto through supply conduit 18 and branch conduits 17 and 16, respectively, leading into hearth 3 and burner 15. Air supply conduit 18 passes through air heating means 6 at the output of fan 5 and, as indicated by conduit 6*a* and explained more fully hereinafter, the air heating means is traversed by exhaust gases from the boiler.

As the solid fuel is burned and gasified in the fluidized bed on inclined mobile grid 3, the gasified fuel rises therefrom into lower boiler body portion 1*a* at a temperature of the order of 1200° C. It passes through the lower boiler body portion and is removed therefrom through outlet pipe 8 connected to the lower boiler body portion substantially below transverse wall 2 at a temperature of about 900° C., which is very favorable to desulfurization of the gasified fuel. In the operation of this installation, lower boiler body portion 1*a* thus serves essentially as a cooling chamber for the gasified fuel.

In the illustrated embodiment of the boiler installation, the means for removing dust from the gasified fuel is comprised of cyclone 9 arranged to separate floating particles from the gasified fuel, the input of the cyclone being connected to outlet pipe 8, and means constituted by inlet pipe 10 leading from the bottom of cyclone 9 into the lower boiler body portion for recycling the separated floating particles to the hearth. These floating particles rising with the gasified fuel from the fluidized bed consist essentially of incombustile fuel components and ashes, and they are eventually removed through outlet 7 from hearth 3. The gasified fuel, from which the floating particles have been removed, leaves cyclone 9 at the top and passes through a conduit to station 11 for injecting a desulfurizing agent into the conduit, the station being arranged downstream between cyclone 9 and burner 15. The desulfurizing agent may be a $CaCO_3$-containing compound, such as dolomite, limestone or chalk, for example. Conduit section 12 is connected to station 11 and is of sufficient length to permit the desulfurizing agent to react with the gasified fuel until the gasified fuel has been substantially desulfurized. In the preferred embodiment herein illustrated, conduit section 12 has the shape of an inverted U. Another cyclone 13 is connected to conduit section 12 and is arranged to separate residues of the desulfurization reaction, such as CaS, CaO and excess amounts of $CaCO_3$, for example, from the gasified fuel. These reaction residues are removed from the bottom of cyclone 13 while supply conduit 14 delivers the purified gasified fuel from the top of the cyclone to burner 15 extending into upper boiler body portion 1*b* near transverse dividing wall 2 and simultaneously receiving secondary combustion air through supply conduit 16. In the operation of the installation, upper boiler body portion 1*b* thus serves as the combustion chamber of the boiler. The exhaust gases leaving the combustion chamber heat the coils 19 and 20 of a heat exchanger whence they are delivered into conduit 6*a* traversing heating means 6 for the primary and secondary air supplied to the boiler in the above-described manner.

As indicated in broken lines, branch conduit 21 leads upstream of branch conduit 17 and downstream of the output of fan 5 to lower boiler body portion 1*a* for directly injecting thereinto a part of the heated air fed by fan 5. This arrangement makes it possible to vary the quantity of secondary air supplied to burner 15. It is particularly advantageous if the installation operates at reduced capacity to obtain a partial secondary combustion in upper boiler body portion 1*b*, and to limit the temperature drop of the gases exhausted from the portion 1*a* so that it is not too far removed from the temperature level most favorable for the desulfurization of the gasified fuel.

Figure 2:
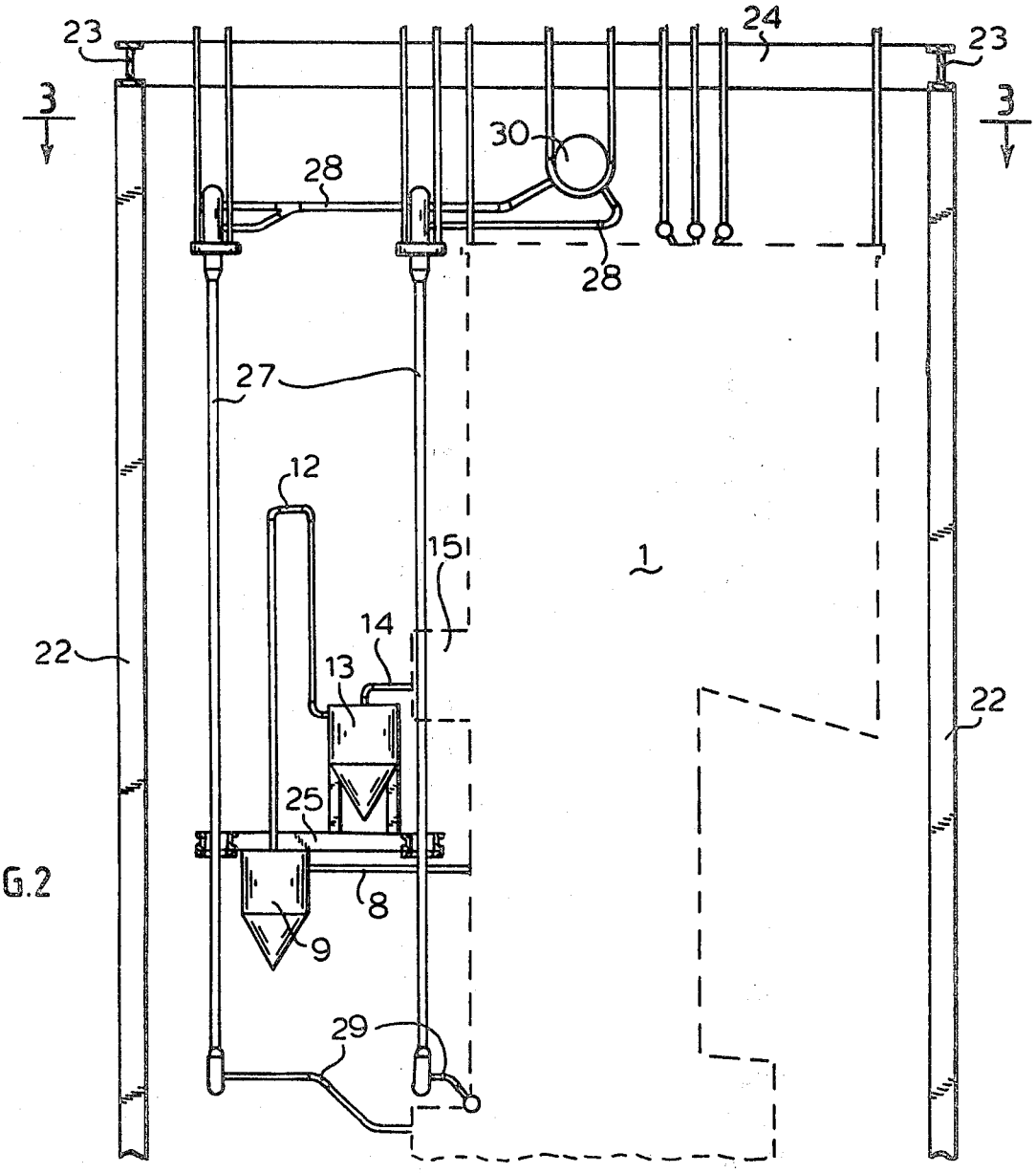
FIG. 2 is a similar view of an assembled boiler unit suspended from a support frame.
Figure 3:
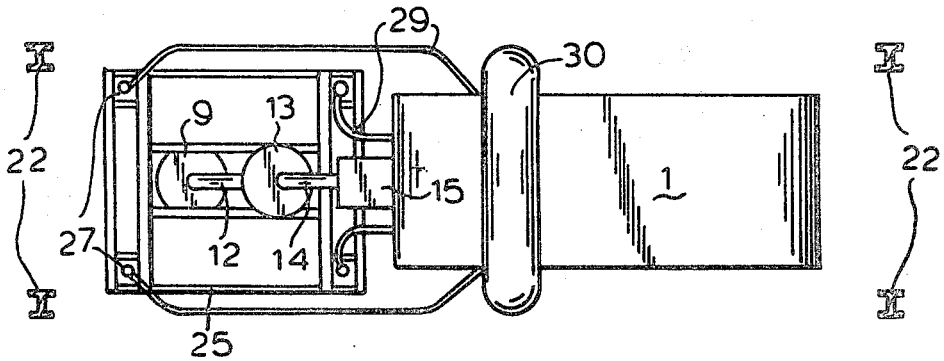
FIG. 3 is a transverse section along line A—A of FIG. 2.

FIGS. 2 and 3 illustrate a preferred embodiment of a mounting of the boiler installation. For simplicity's sake, the installation has been shown merely in outlines and various elements of the air circuit have been omitted.

The illustrated mounting comprises a support frame comprising four posts 22 supporting I-beams 23 on which crossbeams 24 are mounted. All the boiler installation components are suspended from the support frame crossbeams, including tubular boiler body 1 and at least two water feed columns 27 supporting carrier structure 25 for cyclones 9 and 13 at the same level as the boiler body. Water supply pipes 28 connect water storage tank 30, which is also suspended from the support frame, to the top of the water feed columns whose bottoms are connected by water supply pipes 29 to the bottom of the tubular boiler body to feed the boiler with water to be heated. This mounting has the advantage that, on the one hand, water feed columns 27, through which the boiler water runs, have practically the same temperature as the tubes constituting the walls of boiler body 1 and, on the other hand, since these columns are suspended from the same support frame as the boiler body, they expand in the same manner, the origins of the expansion emanating substantially from the same horizontal plane. Therefore, cyclones 9 and 13 always remain in the same relative position to boiler body 1, i.e. respectively facing the outlet of lower boiler body portion 1*a* and burner 15 in upper boiler body portion 1*b*.

Figure 4:
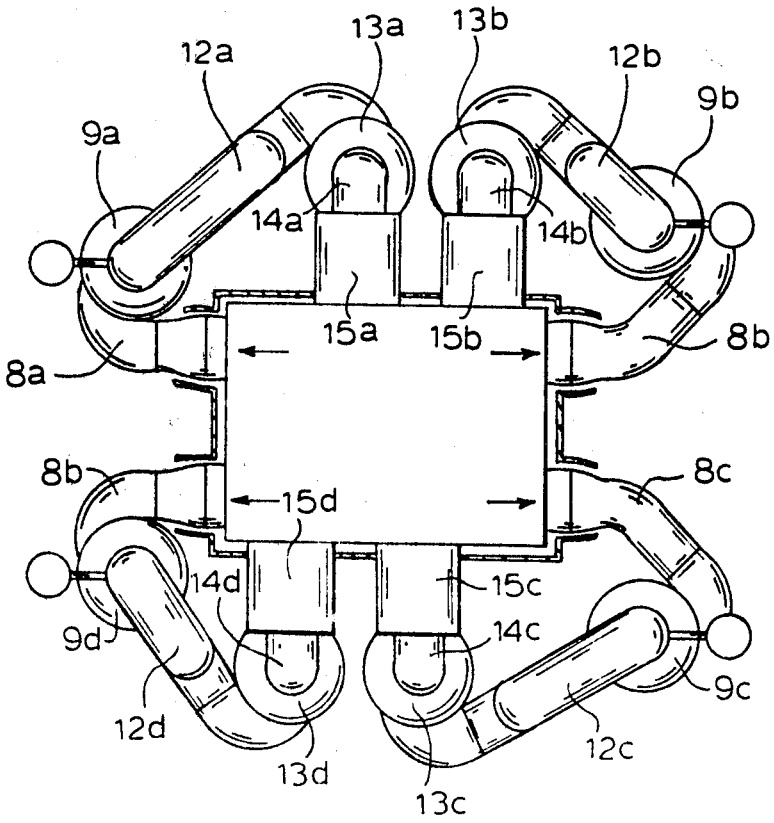
FIG. 4 shows a transverse section of a boiler body at the level of the gasified fuel outlet conduits, the illustrated boiler installation being equipped with four such conduits, and a top view of the conduit means outside the boiler body.
Figure 5:
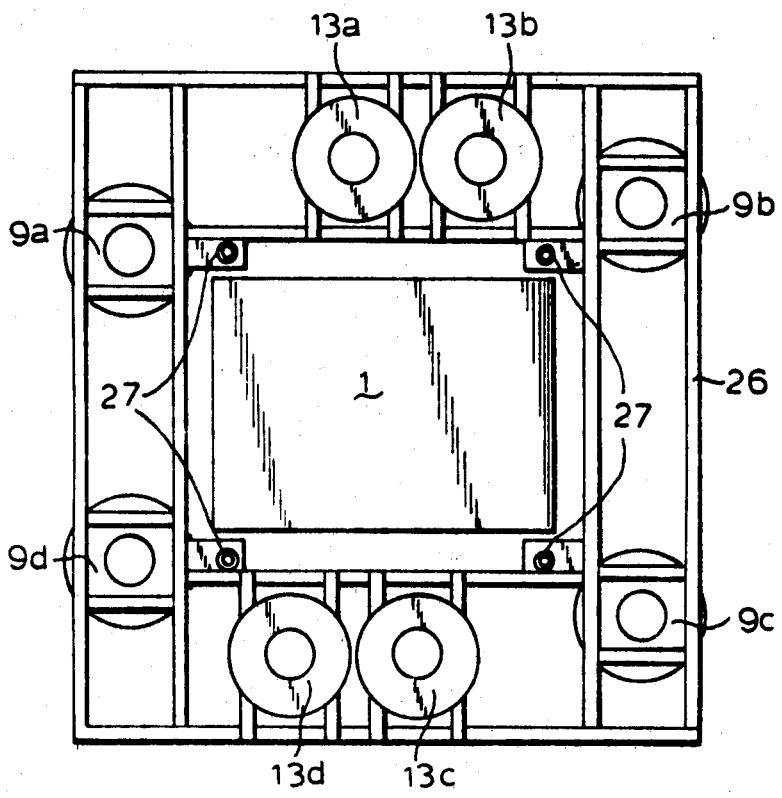
FIG. 5 is a plan view showing the support for the cyclones used in the installation of FIG. 4.

FIGS. 4 and 5 show a preferred embodiment wherein four outlet pipes 8*a*, 8*b*, 8*c*, 8*d* are connected to lower boiler body portion 1*a* for discharging the gasified fuel coming from hearth 3, two respective cyclones 9*a*, 13*a*, 9*b*, 13*b*, 9*c*, 13*c* and 9*d*, 13*d* being associated with each outlet pipe. Rectangular frame 26 surrounds boiler body 1. The cyclones are mounted on frame 26 about the boiler body and the frame is affixed to water feed columns 27. Correspondingly, four burners 15*a*, 15*b*, 15*c* and 15*d* are mounted in the upper boiler body portion and receive the purified gasified fuel through inlet pipes 14*a*, 14*b*, 14*c*, 14*d* from cyclones 13*a*, 13*b*, 13*c*, 13*d* which are fed by long conduit sections 12*a*, 12*b*, 12*c*, 12*d*. It will be seen from FIG. 4 that pairs of gasified fuel outlet pipes are arranged at opposite walls of boiler body 1 while pairs of burners are arranged at the opposite boiler body walls at right angles thereto. Each outlet pipe at one wall is connected to a burner at the adjacent, perpendicularly extending wall.

While the invention has been described in connection with certain now preferred embodiments thereof, it will be understood that many modifications and variations may occur to those skilled in the art, particularly in connection with the substitution of equivalent mechanical means for those herein described and illustrated, and the scope of the invention is defined solely by the appended claims.

What is claimed is:

1. A boiler installation comprising (a) a hearth for burning and thereby gasifying a solid fuel, the hearth including
  (1) a grid supporting a fluidized bed of the solid fuel spread thereover, and
  (2) means for blowing primary combustion air through the grid from below;

(b) a tubular boiler body superimposed on, and integral with, the hearth, the boiler body including
  (1) a lower portion receiving the gasified fuel from the hearth,
  (2) an upper portion,
  (3) a common transverse wall dividing the tubular boiler body into the lower and upper portions, and
  (4) a burner extending into the upper boiler body portion near the dividing transverse wall and receiving a supply of secondary combustion air;

(c) conduit means connecting the lower boiler body portion to the burner for feeding the gasified fuel therefrom to the burner; and (d) dust removing and desulfurization means in the conduit means for removing dust and sulfur from the gasified fuel.

2. The boiler installation of claim 1, wherein the grid is mechanically movable to assure distribution of the primary combustion air and removal of ashes from the fluidized bed.

3. The boiler installation of claim 1, wherein the transverse dividing wall is a tubular wall consisting of inward folds of the vertical tubes forming the boiler body.

4. The boiler installation of claim 1, wherein the means for removing dust from the gasified fuel is comprised of a cyclone arranged to separate floating particles from the gasified fuel and means for recycling the separated floating particles to the hearth.

5. The boiler installation of claim 4, wherein the desulfurization means comprises a station for injecting a desulfurizing agent into the conduit means, the station being arranged downstream between the cyclone and the burner, a conduit section connected to the station and of sufficient length to permit the desulfurizing agent to react with the gasified fuel until the gasified fuel has been substantially desulfurized, and another cyclone connected to the conduit section and arranged to separate residues of the desulfurization reaction from the gasified fuel.

6. The boiler installation of claim 5, wherein the conduit section has the shape of an inverted U.

7. The boiler installation of claim 1, further comprising a fan having an output for feeding the primary and secondary combustion air to the hearth and to the burner, respectively.

8. The boiler installation of claim 7, further comprising air heating means at the output of the fan, the air heating means being traversed by exhaust gases from the boiler.

9. The boiler installation of claim 7, further comprising a branch conduit downstream of the fan output and connected to the lower boiler body portion for directly injecting thereinto a part of the air fed by the fan.

10. The boiler installation of claim 1, wherein the dust removing and desulfurization means comprise respective cyclones, and further comprising a support frame from which the tubular boiler body is suspended and water feed columns, the cyclones and water feed columns forming a unit suspended from the support frame at the same level as the boiler body.

11. The boiler installation of claim 10, wherein the conduit means connecting the lower boiler body portion to the burner comprises four gasified fuel outlet conduits, two respective ones of the cyclones being associated with each outlet conduit, and further comprising a frame surrounding the tubular boiler body, the cyclones being mounted on the frame about the boiler body, the frame being affixed to the water feed columns.

* * * * *